United States Patent [19]

Yamazaki et al.

[11] 4,332,146

[45] Jun. 1, 1982

[54] DRIVE FORCE TRANSMITTING DEVICE FOR ICE-MAKING TRAY OF AUTOMATIC ICE-MAKING MACHINE

[75] Inventors: Susumu Yamazaki; Yoshinari Nagoya, both of Ohiramachi; Masajiro Shimizu, Tokyo, all of Japan

[73] Assignee: Hitachi, Ltd., Tokyo, Japan

[21] Appl. No.: 209,660

[22] Filed: Nov. 24, 1980

[51] Int. Cl.[3] ..... F25C 5/06

[52] U.S. Cl. ..... 62/353; 74/48

[58] Field of Search ..... 62/72, 353; 74/48, 98, 74/DIG. 10

[56] References Cited

U.S. PATENT DOCUMENTS

| | | | |
|---|---|---|---|
| 3,308,631 | 3/1967 | Kniffin | 62/72 X |
| 3,563,050 | 2/1971 | Fox | 62/72 X |
| 3,775,992 | 12/1973 | Bright | 62/353 X |
| 4,142,377 | 3/1979 | Fogt | 62/353 X |
| 4,142,378 | 3/1979 | Bright et al. | 62/353 X |

FOREIGN PATENT DOCUMENTS

| | | | |
|---|---|---|---|
| 2712719 | 9/1978 | Fed. Rep. of Germany | 74/DIG. 10 |

*Primary Examiner*—William E. Tapolcai, Jr.
*Attorney, Agent, or Firm*—Craig and Antonelli

[57] ABSTRACT

A device for transmitting drive force to an ice-making tray of an ice making machine includes a slider interposed between a drive motor gear and a gear directly connected to the ice-making tray, and a cam gear meshing with the drive motor gear. The slider is formed with a gear portion meshing with the gear directly connected to the ice-making tray for rotating same both clockwise and counterclockwise, and a guide groove receiving therein an actuating pin formed in the cam gear for moving the slider in pivotal movement in a predetermined range of angles. Rotational movement of a drive motor can be converted into clockwise and counterclockwise rotational movements of the ice-making tray by the guide groove cooperating with the actuating pin, and a twisting movement and a countertwisting movement can be imparted to the ice-making tray by the conjoint actions of the slider, cam gear having the actuating pin, gear directly connected to the ice-making tray and bent rise portions formed in a frame, so that the ice cubes formed in the ice-making tray can be automatically released therefrom.

5 Claims, 9 Drawing Figures

DRIVE FORCE TRANSMITTING DEVICE FOR ICE-MAKING TRAY OF AUTOMATIC ICE-MAKING MACHINE

BACKGROUND OF THE INVENTION

This invention relates to automatic ice-making machines capable of automatically performing the operations of making ice, releasing ice and feeding water, and more particularly it is concerned with a device of the machine of the type described for efficiently transmitting the force of rotation of the drive motor gear to the gear directly connected to the ice-making tray while increasing the force of rotation.

In an automatic ice-making machine of the prior art, an expensive motor capable of rotating both clockwise and counterclockwise is used for driving the ice-making tray for rotating the ice-making tray both clockwise and counterclockwise. This type of automatic ice-making machine of the prior art has suffered the disadvantage that the lack of a device for effectively transmitting the force of rotation provided by the drive motor to the gear directly connected to the ice-making tray while increasing the force of rotation has increased the production cost of the ice-making machine because the motor used should have a high capacity.

SUMMARY OF THE INVENTION

This invention has been developed for the purpose of obviating the aforesaid disadvantage of the art. Accordingly, the invention has as its object the provision of an ice-making machine having a device capable of rotating the ice-making tray both clockwise and counterclockwise by using a motor rotating in one direction only, which device efficiently transmits necessary torque to the gear directly connected to the ice-making tray while effectively increasing the force of rotation of the drive motor.

The outstanding characteristic of the invention is that the drive force transmitting device for the ice-making tray comprises a cam gear rotatably supported in meshing engagement with a drive gear connected to a drive motor and having an actuating pin projecting axially thereof, and a slider rotatably supported at one end portion including a guide groove formed at the other end portion opposite the one end portion for receiving the actuating pin, and a gear portion disposed midway between the one end portion and the guide groove. The slider is pivotally moved both clockwise and counterclockwise by the actuating pin cooperating with the guide groove as the actuating pin moves in rotary movement, so that a gear directly connected to the ice-making tray and meshing with the gear portion of the slider can be rotated to transmit the drive force to the ice-making tray.

DETAILED DESCRIPTION OF THE PREFERRED EMBODIMENT

Figure 1:
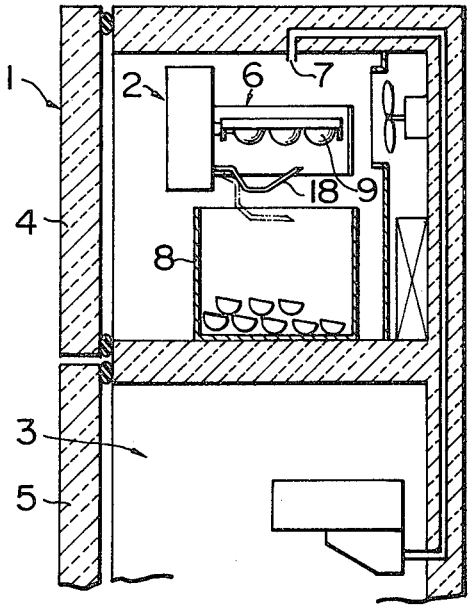
FIG. 1 is a fragmentary vertical sectional view of a refrigerating apparatus incorporating therein the drive force transmitting device according to the invention.
Figure 2:
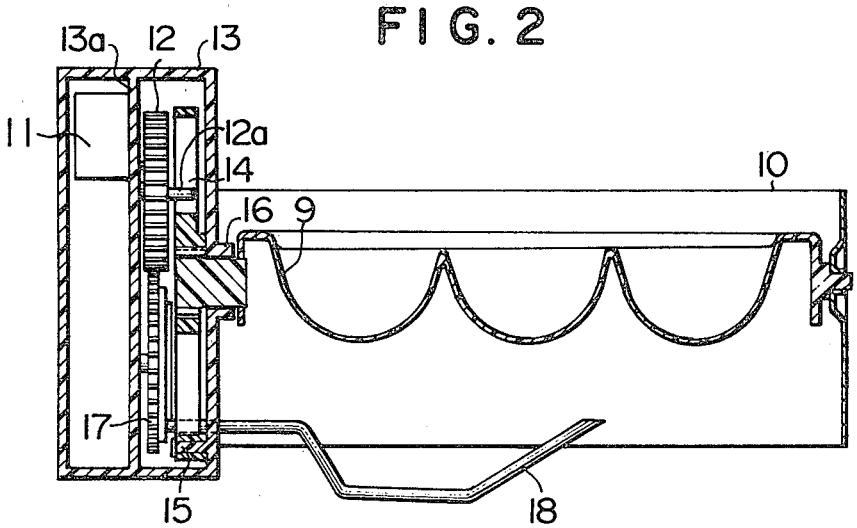
FIG. 2 is a sectional view of an ice-making machine provided with the drive force transmitting device according to the invention.

The invention will now be described by referring to an embodiment shown in the accompanying drawings. The numeral 1 designates a main body of a refrigerating apparatus having a freeze storing chamber 2 and a refrigerating chamber 3. The freeze storing chamber 2 is closed by a door 4, and the refrigerating chamber 3 is closed by a door 5. The numeral 6 designates an automatic ice-making machine incorporating therein the drive force transmitting device according to the invention.

The numeral 7 designates a feedwater inlet port for feeding water to an ice-making tray, presently to be described, from a cold water tank mounted in the refrigerating chamber 3. The numeral 8 designates an ice bank for storing ice made in the ice-making machine 6. The ice-making tray 9 mounted in a position above the ice bank 8 is flexible and formed of a synthetic resinous material, such as polyethylene, polystyrol, polypropylene, ABS resin. The ice-making tray 9, which is rotated through a predetermined angle as a pair of sides thereof disposed opposite to each other abut against bent rise portions 10*a* and 10*b* formed in a frame 10, is mounted at another pair of sides disposed opposite to each other in a direction perpendicular to the direction in which the first-mentioned pair of sides are disposed outside a housing 13 for rotation by a drive motor presently to be described. The drive motor 11 which is a DC motor rotating in one direction only is of 100 V and 5.5 W and has a maximum load of 25–30 kg.cm. A motor gear 11*a* is connected to the drive motor 11 and has an outer diameter of 20 mm and meshes with a cam gear 12 having an outer diameter of 60 mm. The gear ratio of the cam gear 12 and the motor gear 11*a* is 3:1. The motor gear 11*a* and cam gear 12 which are preferably formed of a self-lubricating synthetic resinous material, such as acetal resin, by injection molding are both mounted on a mounting plate 13*a* in the housing 13. The cam gear 12 includes an actuating pin 12*a* formed integrally with the cam gear 12 and projecting axially thereof in a direction opposite to the mounting plate 13*a* at a position spaced apart from the center of the cam gear 12 by 21 mm. The actuating pin 12*a* has a diameter of 5.5 mm and extends for a distance of 12 mm or has a height of 12 mm.

Figure 5:
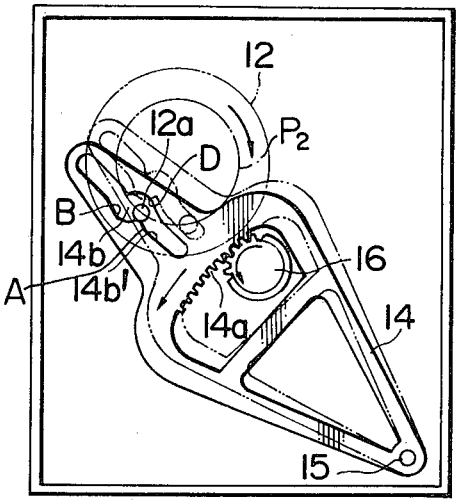
FIG. 5 is a view showing the positional relation between the slider and the cam gear as a twisting movement is imparted to the ice-making tray.

A slider 14 comprises a main body 14' of a substantially triangular shape, and a projecting portion 14'' formed integrally with the main body 14' and projecting from the base side of the triangle. The slider 14 is pivotally connected to the housing 13 by a pin 15 at the top of the main body 14' opposite to the projecting portion 14''. The main body 14' is formed with an opening 14c of a substantially trapezoidal shape, and a bottom side of the trapezoidal opening 14c spaced apart from the pin 16 by 8.8 mm is formed thereon with a gear portion 14a which is in meshing engagement with a gear 16 directly connected to the ice-making tray 9 for rotating the latter both clockwise and counterclockwise. The projecting portion 14'' of the slider 14 is formed with a straight guide groove 14b extending along a straight line connecting the forward end of the projecting portion 14'' and the pin 15. The guide groove 14b has a depth of 10 mm and a width of 6 mm, with an increased width portion 14d being disposed in the central portion of the groove 14b. The guide groove 14b receives the actuating pin 12a of the cam gear 12, rotation of which rotates the actuating pin 12a along a path of movement P2 (See FIG. 5) while the actuating pin 12a also moves in the guide groove 14b, so as to pivotally move the slider 14 both clockwise and counterclockwise. The guide groove 14b is formed with inwardly projecting portions 14e and 14f each having an inclined surface at positions at which straight lines 14b' and 14b'' defining the guide groove 14b are contiguous with the increased width portion 14d. The inwardly projecting portion 14e cooperates with the actuating pin 12a to impart a twisting movement (elastic deformation) to the ice-making tray 9 for releasing the ice therefrom. The distance between the inwardly projecting portion 14e and the axis of the pin 15 is 11.5 mm. The other inwardly projecting portion 14f enables the ice-making tray 9 to move in countertwisting movement, to avoid the development of torsional deformation the ice-making tray 9. The inwardly projecting portions 14e and 14f extend for distances of about 1 mm and about 0.5 mm respectively.

Figure 3:
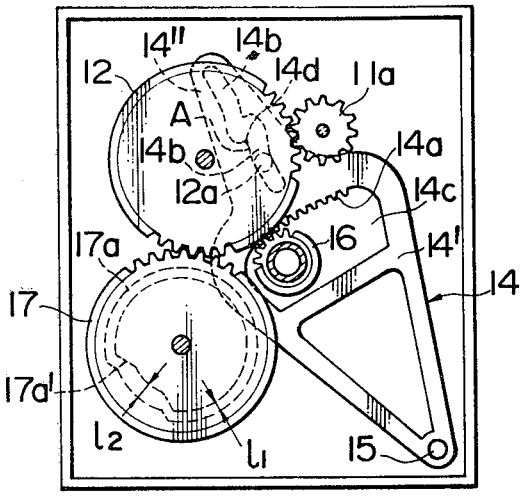
FIG. 3 is a view in explanation of the operation of the ice-making machine provided with the drive force transmitting device according to the invention.
Figure 9:
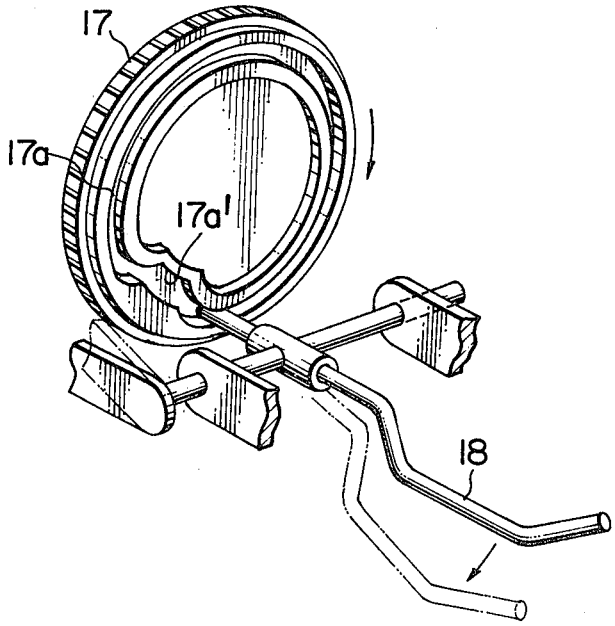
FIG. 9 is a view showing drive means for the level sensor.

The numeral 17 designates a gear for a level sensor 18 having an outer diameter of 60 mm which meshes with the cam gear 12 and rotates in synchronism therewith. The gear 17 is formed with a guide groove 17a which extends along the circumference of a circle cocentric with the gear 17 for a circumferential extent of about 300° and along a portion 17a' for a circumferential extent of about 60° which is disposed nearer to the center axis of the gear 17 than the concentric arc portion as shown in FIG. 3. The guide groove 17a has the function of moving the level sensor 18 normally disposed in a solid line position shown in FIGS. 1 and 9 downwardly to a dash-and-dot line position as the level sensor 18 engaged at one end in the guide groove 17a engages the portion 17a' during rotation of the gear 17. The time during which the level sensor 18 is moved downwardly is set at about 1/6 the time during which the gear 17 makes one complete revolution. The level sensor 18 is forcedly moved downwardly by the guide groove 17a and 17a' when it begins to move downwardly and when it is moved upwardly. The guide groove 17a has a width of $l_1=3.5$ mm and the groove portion 17a' has a width of $l_2=5.2$ mm (See FIG. 3), so that detection of the amount of ice stored in the ice bank 8 may not be interfered with by the groove portion 17a' after the level sensor 18 has started its downward movement.

Figure 4:
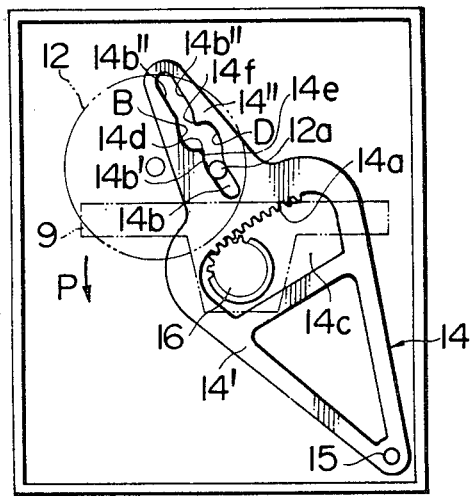
FIG. 4 is a view showing the relation between the slider and the ice-making tray.
Figure 6:
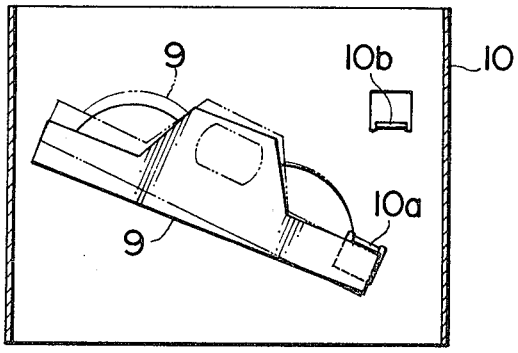
FIG. 6 shows the position of the ice-making tray when the drive force transmitting device is in the position shown in FIG. 5.

Operation of the drive force transmitting device according to the invention for an ice-making tray of an automatic ice-making machine which is of the aforesaid construction will now be described. When the ice-making tray 9 is kept in a horizontal position as shown in broken lines in FIG. 4, the gear 16 directly connected to the ice-making tray 9, slider 14 and actuating pin 12a are all in solid line positions. As the time comes when the ice-making tray 9 is to be rotated in the direction of an arrow P in FIG. 4, the actuating pin 12a begins to move downwardly in the straight portion 14b' of the guide groove 14b of the slider 14 and abuts against the lowermost end of the guide groove 14b when the slider has pivotally moved through about one half the rotational angle of about 20° through which the slider 14 is designed to rotatively move. Then the actuating pin 12a begins to move upwardly in the straight portion 14b' of the guide groove 14b. The gear 16 directly connected to the ice-making tray 9 and the gear portion 14a of the slider 14 are constructed such that the ice-making tray 9 completes its rotation through a predetermined angle of 150° when the actuating pin 12a reaches a portion A immediately before the inwardly projecting portion 14e of the guide groove 14b. As the actuating pin 12a reaches the portion A, the slider 14 is in a dash-and-dot line position shown in FIG. 5. When the ice-making tray 9 has rotated through the predetermined angle of 150°, the ice-making tray 9 is locked in position by the bent rise portion 10a of the frame 10. The actuating pin 12a continues its upward movement and rises on the inwardly projecting portion 14e. At this time, a force of a large magnitude tending to deflect the actuating pin 12a from its path of movement is exerted on the slider 14 by the mutual action of the inwardly projecting portion 14e of the guide groove 14b and the actuating pin 12a. As a result, the slider 14 further moves (to a solid line position in FIG. 5), so that the gear 16 also rotates and imparts a twisting movement (elastic deformation) to the ice-making tray 9 (See FIG. 6) whereby the ice in the ice-making tray 9 can be positively released therefrom.

Figure 7:
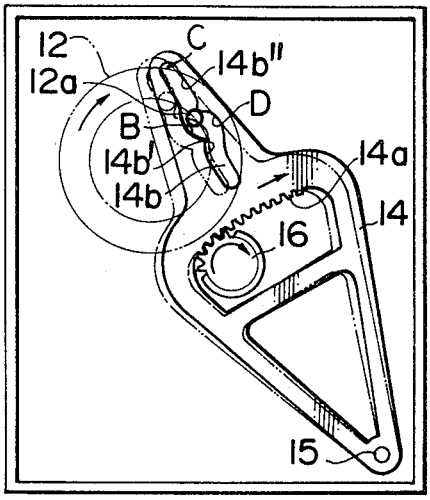
FIG. 7 is a view showing the positional relation between the slider and the cam gear as the ice-making tray is restored to its original position.
Figure 8:
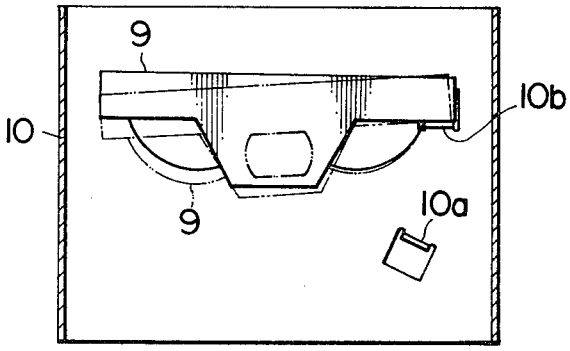
FIG. 8 is a view showing the position of the ice-making tray when the drive force transmitting device is in the position shown in FIG. 7.

Upon completion of the twisting movement of the ice-making tray 9, the actuating pin 12a is temporarily released from engagement in the guide groove 14b as the former reaches a portion B (See FIG. 7) and then moves into the straight portion 14b''. The actuating pin 12b in the straight portion 14b'' acts to move the slider 14 in pivotal movement in a direction opposite to the direction indicated by the arrow P, and when the actuating pin 12b reaches a portion C (in which the slider 14 is in a dash-and-dot line position in FIG. 7) the ice-making tray 9 is restored to its original horizontal position. At this time, the ice-making tray 9 is locked by the bent rise portion 10b formed in the frame 10. Further movement of the actuating pin 12a brings the pin on the inwardly projecting portion 14f when the slider 14 is pivotally moved with high torque, so that the gear 16 also rotates. By this action, the torsion imparted to the ice-making tray 9 is undone as shown in FIG. 8. Then the actuating pin 12a reaches a portion D shown in FIG. 7 where it releases the ice-making tray 9 from the twisting movement, and becomes stationary as it returns to the straight portion 14b' (See FIG. 4).

As described hereinabove, the actuating pin 12a engaged in the guide groove 14b formed in the slider 14 moves along its path of movement $P_2$ while moving the slider 14 in pivotal movement about the pin 15 to thereby rotate the ice-making tray 9 both clockwise and counterclockwise. The ice-making tray 9 is rotated through an angle over a predetermined level when the actuating pin 12a abuts against the straight portion of the groove, and the rotational force from the motor is effectively transmitted to the ice-making tray by the conjoint actions of the inwardly projecting portions 14e and 14*f* and inclined surfaces of the groove, to thereby impart a twisting movement to the ice-making tray.

From the foregoing description, it will be appreciated that the present invention provides, in an ice-making machine of the type having an ice-making tray formed of an elastic material and having directly connected thereto a gear associated with a drive motor gear for rotating the ice-making tray and at the same time twisting same to release the formed ice when ice-making therein is completed, a slider interposed between the drive motor gear and the gear directly connected to the ice-making tray, and a cam gear in meshing engagement with the drive motor gear and including an actuating pin. The slider is formed with a gear portion capable of rotating the gear directly connected to the ice-making tray both clockwise and counterclockwise, and a guide groove adapted to receive the actuating pin of the cam gear for moving the slider in pivotal movement in a predetermined range of angles. By this feature, the rotational movement of a drive motor can be converted into clockwise and counterclockwise angular rotation of the ice-making tray by the guide groove of the slider cooperating with the actuating pin of the cam gear. At the same time, a twisting movement and a counter-twisting movement can be imparted to the ice-making tray by the conjoint actions of the slider, cam gear having the actuating pin, gear directly connected to the ice-making tray and bent rise portions formed in a frame. Thus the invention enables the ice-making tray to rotate both in the normal and reverse directions without requiring to use an expensive motor capable of rotating both in the normal and reverse directions and without requiring to effect rotation of the ice-making tray both in the normal and reverse directions by means of a DC motor. Moreover, the invention enables a twisting movement to be imparted to the ice-making tray for facilitating release of the ice therefrom and a counter-twisting movement to be imparted thereto to avoid deformation of the ice-making machine by the guide gear of the slider cooperating with the actuating pin of the cam gear by using a motor of a relatively small power.

What is claimed is:

1. A device for transmitting a drive force to an ice-making tray for an automatic ice-making machine comprising:

a drive motor rotating in one direction only;

a drive gear connected to and rotatably supported by the drive motor;

a cam gear meshing with the drive gear and supported for rotation, said cam gear including an actuating pin extending axially thereof;

a slider pivotally supported at one end portion and formed at the other end portion opposite said one end portion with a guide groove for receiving said actuating pin and a gear portion disposed midway between said one end portion and said guide groove, said slider being moved in pivotal movement both clockwise and counterclockwise by said guide groove cooperating with said actuating pin as the actuating pin moves in rotational movement; and an ice-making tray having a gear directly connected thereto and meshing with the gear portion of said slider, said ice-making tray being supported for rotation through a predetermined range of angles, wherein said cam gear, said drive gear, said slider and said gear directly connected to the ice-making tray are formed of self-lubricating acetal resin by injection molding, and wherein said actuating pin is formed integrally with said cam gear when the latter is formed by injection molding and disposed in the vicinity of an outer peripheral portion of the cam gear, and wherein said slider comprises a main body of a substantially triangular shape pivotally supported at one apex portion, and a projecting portion extending outwardly from a side opposite said one apex portion, said main body being formed with an opening defined by a plurality of sides and said gear portion at one of said plurality of sides, said guide groove being disposed in said projecting portion and extending substantially straightforwardly.

2. A device for transmitting a drive force to an ice-making tray of an automatic ice-making machine comprising:

a drive motor rotating in one direction only;

a drive gear connected to and rotatably supported by the drive motor;

a cam gear meshing with the drive gear and supported for rotation, said cam gear including an actuating pin extending axially thereof;

a slider pivotally supported at one end portion and formed at the other end portion opposite said one end portion with a guide groove for receiving said actuating pin and a gear portion disposed midway between said one end portion and said guide groove, said slider being moved in pivotal movement both clockwise and counterclockwise by said guide groove cooperating with said actuating pin as the actuating pin moves in rotational movement; and an ice-making tray having a gear directly connected thereto and meshing with the gear portion of said slider, said ice-making tray being supported for rotation through a predetermined range of angles, wherein said slider comprises a main body of a substantially triangular shape pivotally supported at one apex portion, and a projecting portion extending outwardly from a side opposite said one apex portion, said main body being formed with an opening defined by a plurality of sides and said gear portion at one of said plurality of sides, said guide groove being disposed in said projecting portion and extending substantially straightforwardly.

3. A device as claimed in claim 1 or 2, wherein said substantially straightforwardly extending guide groove is formed with an increased width portion in a central portion, and said central portion is formed at opposed edges with a pair of inwardly extending projecting portions, said inwardly projecting portions cooperating with the actuating pin moving in the guide groove to cause high torque to be produced in the slider for imparting twisting deformation and counter-twisting deformation to the ice-making tray.

4. A device as claimed in claim 3, wherein said inwardly projecting portion for imparting twisting deformation to the ice-making tray extends inwardly for about 1 mm, and said inwardly projecting portion for imparting counter-twisting deformation to the ice-making tray extends inwardly for about 0.5 mm.

5. A device as claimed in claim 3, wherein the inwardly projecting portion for imparting twisting deformation to the ice-making tray is spaced apart from a pin for pivotally supporting the slider by 11.5 mm, and the gear portion of the slider is spaced apart from the pin for pivotally supporting the slider by 8.8 mm.

* * * * *